United States Patent [19]

Hennechart et al.

[11] Patent Number: 4,502,408

[45] Date of Patent: Mar. 5, 1985

[54] INSTALLATION FOR THE CONTINUOUS COATING OF A STRIP, ESPECIALLY FOR THE GALVANIZING OF SHEET STEEL

[75] Inventors: Jean-Paul Hennechart, Mouzon; Bernard Bramaud, Nanterre; Francois Prat, Mouzon, all of France

[73] Assignee: Ziegler S.A., Paris, France

[21] Appl. No.: 597,049

[22] Filed: Apr. 5, 1984

[30] Foreign Application Priority Data

Apr. 13, 1983 [FR] France ..... 83 06055

[51] Int. Cl.[3] ..... B05C 3/12

[52] U.S. Cl. ..... 118/61; 118/63; 118/65; 118/69; 118/308; 118/312; 118/419; 427/192; 427/205; 427/398.4; 427/432; 427/434.2; 427/436; 427/433

[58] Field of Search ..... 427/192, 205, 398.4, 427/432, 433, 434.2, 436; 118/61, 63, 65, 69, 308, 312, 419

[56] References Cited

U.S. PATENT DOCUMENTS 4,111,154 9/1978 Kissel et al. ..... 118/312
4,369,211 1/1983 Nitto et al. .
4,374,873 2/1983 Piedboeuf et al. ..... 427/433
4,444,814 4/1984 Flinchum et al. ..... 427/432 X

FOREIGN PATENT DOCUMENTS 66523 12/1982 European Pat. Off. .
2501724 9/1982 France .
54-139839 10/1979 Japan .

*Primary Examiner*—Shrive P. Beck

[57] ABSTRACT

An installation for the continuous coating of a strip, especially for the galvanizing of sheet steel.

The object of the invention is to improve the quality of the coating and the uniformity of its crystallization, especially for thin sheets with low coating thicknesses. To achieve this result, the minimized flouring nozzle or nozzles are placed in an enclosure from which the strip leaves through a narrow slit and in which is provided means for maintaining a protective atmosphere inside this enclosure.

Preferably, this enclosure is one with an enclosure surrounding the draining means, and means for recycling the protective atmosphere and for purifying it with respect to oxygen are provided.

10 Claims, 1 Drawing Figure

INSTALLATION FOR THE CONTINUOUS COATING OF A STRIP, ESPECIALLY FOR THE GALVANIZING OF SHEET STEEL

FIELD OF THE INVENTION

The present invention relates to an installation for the continuous desposition of a coating on a strip, this deposition being carried out by passing the strip through a bath of the coating material heated above its melting point. The invention applies in particular to the coating of sheet steel with a layer of a metal such as zinc.

PRIOR ART

For a long time, processes have been known in which a thin strip of metal is first drawn continuously through stations for surface preparation and preheating, and then, by virtue of immersed rollers, passes through a bath of a molten coating material, for example zinc, after which it leaves the bath to follow a vertical ascending path. On leaving the bath, it is carrying a layer of liquid coating material whose thickness depends especially on the speed of travel, the temperature of the bath and the surface condition of the strip. This liquid layer solidifies as the strip cools when it emerges from the bath.

To obtain a coating layer of uniform thickness, without impurities and with uniform crystallization, all the factors involved in the operation should be precisely controlled.

In the oldest technique, rollers were used to even out the thickness of the coating layer when it was still liquid. French Pat. No. 1,563,457 describes a more effective method which consists of sending a jet of gas onto this layer of liquid coating material, the gas preferably being air in the case of a lead coating and dry steam in the case of zinc. This jet of gas is produced by a nozzle in the form of a slit, the shape, position, and orientation of which are precisely defined, as is the gas pressure. This produces a jet in the form of a sheet, which removes the outer fraction of the thickness of liquid and causes it to fall back into the bath, carrying with it the dross and oxides which may exist on the surface of the bath.

In current practice, the gas most commonly used for this draining operation is air.

Furthermore, to obtain a coating layer with fine and uniform crystallization, a so-called "minimized flouring" process is known in which a gas charged with crystal nuclei is sprayed onto the strip.

This gas is usually compressed air into which fine solid particles of zinc have been introduced. To prevent those particles which do not become attached to the strip from spreading throughout the workshop, a suction mouth is placed in the immediate vicinity of the blast nozzle and the air sucked out is recycled after filtration.

The accelerated cooling under the effect of the gas jet, combined with the presence of a larger number of nuclei, leads to fine and uniform crystallization.

On the whole, these methods give satisfactory results; however, user requirements are always increasing in strictness and it has been found that the invariability of the finished product is not absolutely perfect as regards the presence of oxides on the surface and the crystallization of the coating material, especially in the case of thin sheets with a low coating thickness.

It was known (British patent application No. A-777,353) to protect the coating from oxidation when it leaves the bath by causing the strip to pass through an enclosure whose walls dip into the bath and whose upper part has a narrow opening through which the strip leaves. An inert gas resides in this enclosure, which also contains rollers for evening out the thickness of the coating.

To improve the quality further, it was proposed (French patent application No. A-2,501,724) to use an inert gas of high purity, for example nitrogen having a very low oxygen content. A gas of this type is expensive and provision was made to recycle it, but, despite the precautions taken (circuits as gastight as possible, cooling and filtration), it is difficult to achieve a recycle ratio of more than 0.5.

Moreover, despite these precautions taken when the strip leaves the bath and is drained, satisfactory control of the crystallization is not always achieved, especially for low thicknesses of sheet steel and for thin coatings. It seems that, in this case, particular problems arise as a consequence of the low thermal inertia of the strip.

SUMMARY OF THE INVENTION

The main object of the present invention is thus to permit better control of the crystallization of the coating material, especially for low thicknesses of steel and small unit weights of coating.

Another object of the invention is to obtain the above-mentioned result at a relatively low cost price and with a simple installation.

The invention thus provides an installation for the continuous coating of a strip, comprising means for successively causing the strip to enter and pass through a molten bath of coating material and causing the strip to leave the bath in an ascending and approximately vertical direction; means for equalizing the thickness of liquid coating material carried by the strip upon leaving the bath; an enclosure surrounding said equalizing means, this enclosure being open towards the bottom and having side walls which dip into the bath, while its upper wall has a narrow slit through which the strip leaves; means for maintaining a protective atmosphere in said enclosure; and at least one nozzle for blasting nuclei, arranged so as to blast onto the strip, above the equalizing means, a jet of gas charged with crystal nuclei of the coating material; whereby this installation has the particular characteristics that the nozzle is placed inside an enclosure from which the strip leaves through a narrow slit and which is provided with means for maintaining a protective atmosphere inside the enclosure.

The provision of a protective enclosure around the nozzle for spraying nuclei makes it possible to prevent the formation of traces of oxides in the coating; moreover, this enclosure permits a more constant temperature at the moment of "minimized flouring".

Of course, to achieve the maximum reduction in the formation of traces of oxides, it is advantageous for the strip also to be protected from contact with the air between the draining enclosure and the minimized flouring enclosure, for example by making provision for these enclosures to be contiguous. In a preferred embodiment, the enclosure containing the nozzle or nozzles for blasting nuclei is contiguous with the enclosure containing the equalizing means.

In an installation in which the blast nozzle or nozzles are fed with at least partially recycled gas, provision is advantageously made in the common technique whereby the recycled gas is to be taken from the enclosure in which the said blast nozzle or nozzles are placed. This arangement makes it possible to limit the eddy currents caused by the presence of a suction mouth in the immediate vicinity of the blast nozzle. These eddy currents detract all the more from the quality, the thinner and more flexible the strip is.

As indicated above, installations are known in which the enclosure surrounding the draining means is associated with a circuit for at least partially recycling the gas forming the protective atmosphere. By way of simplification, it could be envisaged to make provision for a single recycling circuit, in particular if the enclosure is common. Experience has shown that this solution is not the most advantageous and that it is preferable to make provision for the circuit for recycling this gas to be independent of the circuit for recycling the gas for blasting nuclei, even if the enclosure is common to both circuits.

In fact, the speed and temperature of the gas leaving the nozzle for blasting nuclei must be controlled with high precision, which is more difficult to achieve with a common recycling circuit.

Advantageously, to save gas, which can be nitrogen of high purity, provision is made for the circuit for recycling the gas which feeds the nozzle or nozzles for blasting nuclei to include means for purifying this gas by lowering its oxygen content.

In a particularly preferred embodiment, the gas purifying means are arranged so as to produce the crystal nuclei at the same time, and the purifying means preferably include means for introducing into the gas the vapor of a material which is both reducing and capable of producing nuclei, and means for subsequently cooling the gas so as to form the crystal nuclei.

If the two gas recycling circuits are separate, provision can also be made for the gas recycling circuit associated with the equalizing means to comprise gas purifying means for lowering its oxygen content; these means can be operated separately or at the same time as other means provided on the other circuit.

In the case where the nozzle or nozzles for blasting nuclei and the equalizing means are in the same enclosure, provision can also be made for the installation to comprise gas purifying means arranged in the enclosure containing the nozzle for blasting nuclei, or communicating directly therewith.

These means are thus placed in the part common to both recycling circuits in the case where there are two of them. Preferably, the purifying means are placed in the immediate vicinity of the slit provided in the upper wall of the enclosure. This prevents oxygen from inadvertently coming back through the slit counter-current to the movement of the strip. In fact, the slit cannot ensure a perfect seal because its edges must not come into contact with the strip whose coating is in the course of solidifying or has only just solidifed.

BRIEF DESCRIPTION OF THE DRAWING

The invention will now be explained in greater detail with the aid of the attached FIGURE showing a simplified vertical section of the installation.

DETAILED DESCRIPTION

Figure 1:
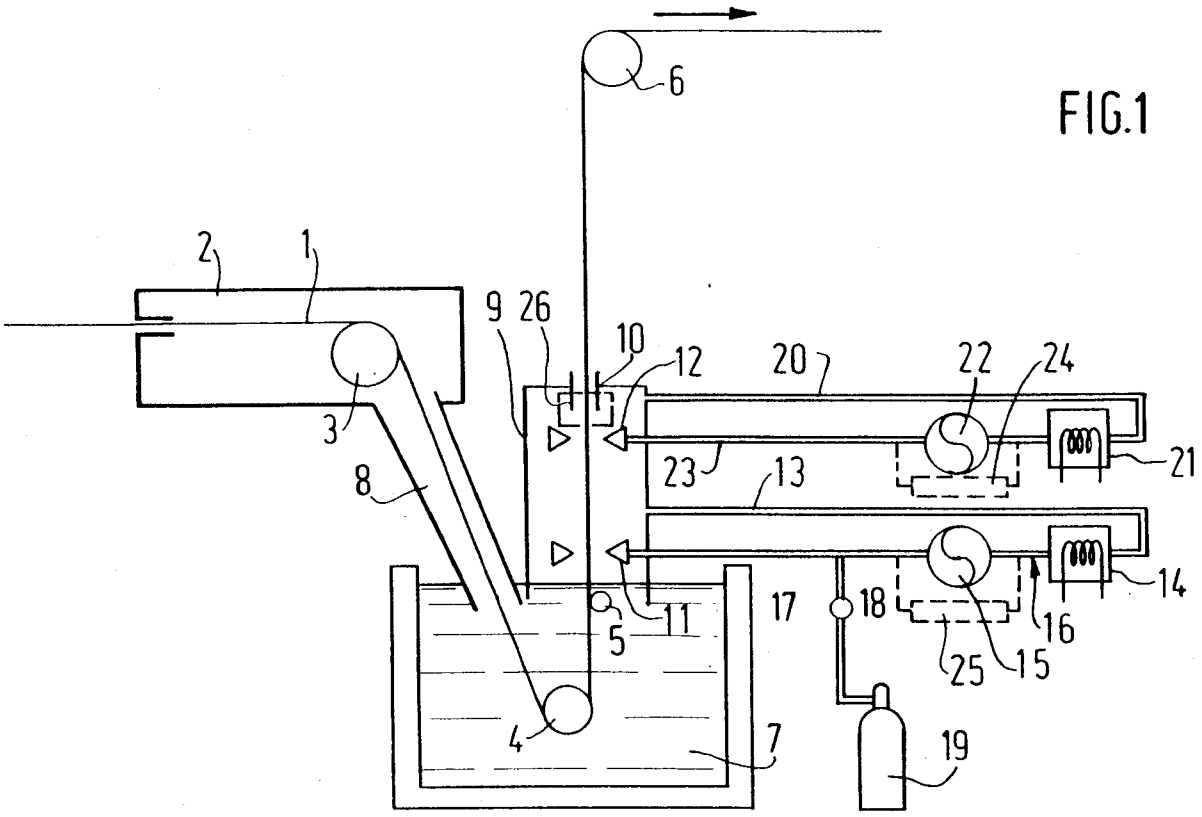

The strip to be coated, 1, arrives at the left of the FIGURE. It first passes through a furnace 2 with a controlled reducing atmosphere, which prepares the surface by reducing the oxides, and at the same time preheats it to a temperature similar to that of the bath. The strip 1, guided by rollers 3, 4, 5, subsequently descends through the molten zinc bath 7 and then returns vertically above the bath and is sent, after a roller 6, to a winding station (not shown). A sheath 8, which dips into the bath and communicates with the furnace 2, surrounds the strip along its path between the furnace 2 and the bath 7 so as to prevent the formation of any oxide on the hot cleaned metal before it comes into contact with the zinc in the bath.

On leaving the bath, the strip is surrounded by a bottomless vessel 9 whose side walls dip into the molten zinc. The roof of the vessel has a very narrow slit 10 through which the strip 1 leaves in the upward direction.

There is no communication between the vessel 9 and the sheath 8 and hence the furnace 2. In fact, it would be very difficult to control the composition, the temperature, and the dust in the vessel 9 if such a communication existed.

Arranged inside the vessel are two draining nozzles 11, in the form of elongated slits, for keeping the thickness of the coating at the desired value, and, above these nozzles are 11, two other nozzles 12 for minimized flouring.

The draining nozzles 11 are fed with nitrogen from a recycling circuit comprising an extraction pipe 13 through which gas is extracted from the vessel 9, and a cold-water cooler 14 which lowers the temperature of the gas in order to improve the operation of a downstream pump 15. A filter 16 is inserted between the cooler and the pump. A feed pipe 17 joins the pump 15 to the draining nozzles 11. Connected to the feed pipe 17 is a nitrogen replenishing pipe 18 fitted with a valve and joined to a source of very pure nitrogen, 19.

The minimized flouring nozzles are fed by an analogous circuit comprising an extraction duct 20, a cooler 21, a pump 22 and a feed pipe 23, but without a replenishing pipe.

Three possible positions of a purifying device have been shown in broken lines:

24 shows the purifying device connected to the minimized flouring gas circuit, and which is then combined with the device for supplying crystal nuclei.

25 shows the purifying device connected to the draining gas circuit; in this case, it can consist of means for injecting a gaseous or liquid hydrocarbon, or an analogous substance, and a hot surface which the gas strikes.

26 shows the purifying device placed in the vessel 9, in the vicinity of the slit 10. This device can comprise one or more hot surfaces and the means for injecting reducing material can be placed at another point in the circuits.

What is claimed is:

1. An installation for the continuous coating of a strip, comprising means for successively causing the strip to enter and pass through a molten bath of coating material and for causing the strip to leave the bath in an ascending and approximately vertical direction; means for equalizing the thickness of liquid coating material carried by the strip on leaving the bath; an enclosure surrounding the equalizing means, said enclosure being open towards the bottom and having side walls which dip into the bath, and having an upper wall provided with a narrow slit through which the strip leaves; means for maintaining a protective atmosphere in the enclosure; and at least one nozzle for blasting nuclei, arranged so as to blast onto the strip, above the equalizing means, a jet of gas charged with crystal nuclei of the coating material, the nozzle being placed inside the enclosure from which the strip leaves through said narrow slit and which is provided with means for maintaining a protective atmosphere inside the enclosure.

2. The installation as claimed in claim 1, wherein the enclosure containing said at least one nozzle for blasting nuclei also contains the equalizing means.

3. The installation as claimed in claim 1 and in which the at least one blast nozzle is fed with at least partially recycled gas, wherein the recycled gas is taken from the enclosure in which the blast nozzle or nozzles are placed.

4. The installation as claimed in claim 3 and in which the enclosure surrounding a draining means is associated with a circuit for at least partially recycling the gas forming the protective atmosphere, wherein the circuit for recycling this gas is independent of the circuit for recycling the gas for blasting nuclei, even if the enclosure is common.

5. The installation as claimed in claim 3, wherein the circuit for recycling the gas feeding said at least one nozzle for blasting nuclei includes means for purifying the gas by lowering its oxygen content.

6. The installation as claimed in claim 5, wherein the gas purifying means are arranged so as to produce crystal nuclei at the same time.

7. The installation as claimed in claim 6, wherein the purifying means include means for introducing into the gas a material vapor which is both reducing and capable of producing nuclei, and means for subsequently cooling the gas so as to form the crystal nuclei.

8. The installation as claimed in claim 4, wherein the gas recycling circuit of the equalizing means comprises means for purifying the gas by lowering its oxygen content.

9. The installation as claimed in claim 3, which comprises gas purifying means arranged in the enclosure containing the nozzle for blasting nuclei, or communicating directly therewith.

10. The installation as claimed in claim 9, wherein the purifying means are placed in the immediate vicinity of the slit through which the strip leaves the enclosure.

* * * * *